US008481124B2

(12) United States Patent
Nolte et al.

(10) Patent No.: US 8,481,124 B2
(45) Date of Patent: Jul. 9, 2013

(54) DEFLECTING AIR RING AND CORRESPONDING COATING PROCESS

(75) Inventors: Hans-Jurgen Nolte, Besigheim (DE); Peter Marquardt, Steinheim (DE); Harald Gummlich, Ludwigsburg (DE); Andreas Fischer, Ludwigsburg (DE); Harry Krumma, Bonnigheim (DE); Jurgen Berkowitsch, Neuhausen (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 882 days.

(21) Appl. No.: 12/524,396

(22) PCT Filed: Feb. 1, 2008

(86) PCT No.: PCT/EP2008/000832

§ 371 (c)(1), (2), (4) Date: Jul. 24, 2009

(87) PCT Pub. No.: WO2008/095657

PCT Pub. Date: Aug. 14, 2008

(65) Prior Publication Data

US 2010/0021646 A1 Jan. 28, 2010

(30) Foreign Application Priority Data

Feb. 9, 2007 (DE) ..... 10 2007 006 547

(51) Int. Cl.

| | |
|---|---|
| ***B05D 1/02*** | (2006.01) |
| ***B05D 1/40*** | (2006.01) |
| ***B05B 3/02*** | (2006.01) |
| ***B05B 3/08*** | (2006.01) |
| ***B07B 7/08*** | (2006.01) |

(52) U.S. Cl.
USPC ... 427/421.1; 118/313; 118/316; 239/222.11; 239/296; 427/427.2

(58) Field of Classification Search
USPC ..... 427/421.1, 427.2; 239/222, 222.11, 239/223, 224, 231, 265.23, 424, 214, 214.11, 239/290, 291, 294, 296, 298, 301; 118/313, 118/315, 316
See application file for complete search history.

(56) References Cited

U.S. PATENT DOCUMENTS 3,923,251 A 12/1975 Flournoy
7,484,673 B2 * 2/2009 Boecking ..... 239/88

(Continued)

FOREIGN PATENT DOCUMENTS

DE 3118601 A1 11/1982
DE 3834674 A1 4/1990

(Continued)

OTHER PUBLICATIONS

International Search Report for PCT/EP2008/000832 dated Mar. 6, 2008.

*Primary Examiner* — Michael Cleveland
*Assistant Examiner* — Alexander Weddle
(74) *Attorney, Agent, or Firm* — Bejin VanOphem Bieneman PLC

(57) ABSTRACT

A deflecting air ring is disclosed having a plurality of deflecting air nozzles for discharging a deflecting air jet onto a spray jet of a vaporizer in order to shape the spray jet. The deflecting air nozzles are configured such that the deflecting air jet is substantially laminar within a close region, while the deflecting air nozzles also generate turbulence in a remote region situated downstream of the close region of the deflecting air jet.

25 Claims, 10 Drawing Sheets

U.S. PATENT DOCUMENTS

| | | | | |
|---|---|---|---|---|
| 2007/0034715 | A1 * | 2/2007 | Clifford et al. | 239/291 |
| 2007/0262170 | A1 * | 11/2007 | Nolte et al. | 239/291 |

FOREIGN PATENT DOCUMENTS

| | | | | |
|---|---|---|---|---|
| DE | 4409848 | A1 | | 10/1995 |
| DE | 19924016 | A1 | | 12/1999 |
| EP | 734780 | A2 | | 10/1996 |
| EP | 801992 | A2 | | 10/1997 |
| EP | 1181984 | A1 | | 2/2002 |
| EP | 1331037 | A2 | * | 7/2003 |
| EP | 1402956 | A2 | | 3/2004 |
| EP | 1439004 | A2 | | 7/2004 |
| GB | 2328629 | A | | 3/1999 |
| JP | 07024367 | A | | 1/1995 |
| JP | 08071455 | A | * | 3/1996 |
| JP | 08071455 | A | | 3/1996 |
| JP | 09094488 | A | * | 4/1997 |
| JP | 09094488 | A | | 4/1997 |
| JP | 2001121043 | A | | 5/2001 |
| JP | 2002224611 | A | | 8/2002 |
| RU | 2089301 | C1 | | 9/1997 |
| RU | 2128087 | C1 | | 3/1999 |
| RU | 2172893 | C1 | | 3/1999 |
| UA | 39186 | | | 6/2001 |
| WO | WO 2006008201 | A1 | * | 1/2006 |

* cited by examiner

DEFLECTING AIR RING AND CORRESPONDING COATING PROCESS

CROSS-REFERENCE TO RELATED APPLICATIONS

This application is a National Phase application claiming the benefit of International Application No. PCT/EP2008/000832, filed Feb. 1, 2008, which claims priority to German Patent Application No. DE 10 2007 006 547.9, filed Feb. 9, 2007, the complete disclosures of which are hereby incorporated in by reference in their entireties.

FIELD

The present disclosure relates to a shaping air ring for an atomizer and a corresponding coating process.

BACKGROUND

The use of high-rotation atomizers is known for the coating of components (for example vehicle body parts) that atomize the coating (for example powder coating or wet paint) to be applied by means of a rapidly rotating bell cup, with the rotating bell cup discharging a spray jet at a circular bell cup edge, and the spray jet widening in the direction of the spray jet. The use of a shaping air jet is further known for shaping the spray jet of this type of high-rotation atomizer, with the shaping air jet being directed by a shaping air ring from behind against the spray jet so that the spray jet is constricted depending on the strength of the shaping air jet.

A disadvantage of the known high-rotation atomizer described above is the fact that particles of the coating which are not deposited on the component to be coated ("overspray") can soil distant surfaces, such as the walls of a paint booth or handling equipment inside the paint booth. Known high-rotation atomizers can thus produce soiling over a great distance.

Therefore, there is a need for minimizing the area that is exposed to soiling by known rotary atomizers and coating processes.

BRIEF DESCRIPTION OF THE DRAWINGS

Various advantageous aspects of the present disclosure are explained in detail using the figures. These show.

DETAILED DESCRIPTION

Figure 1:
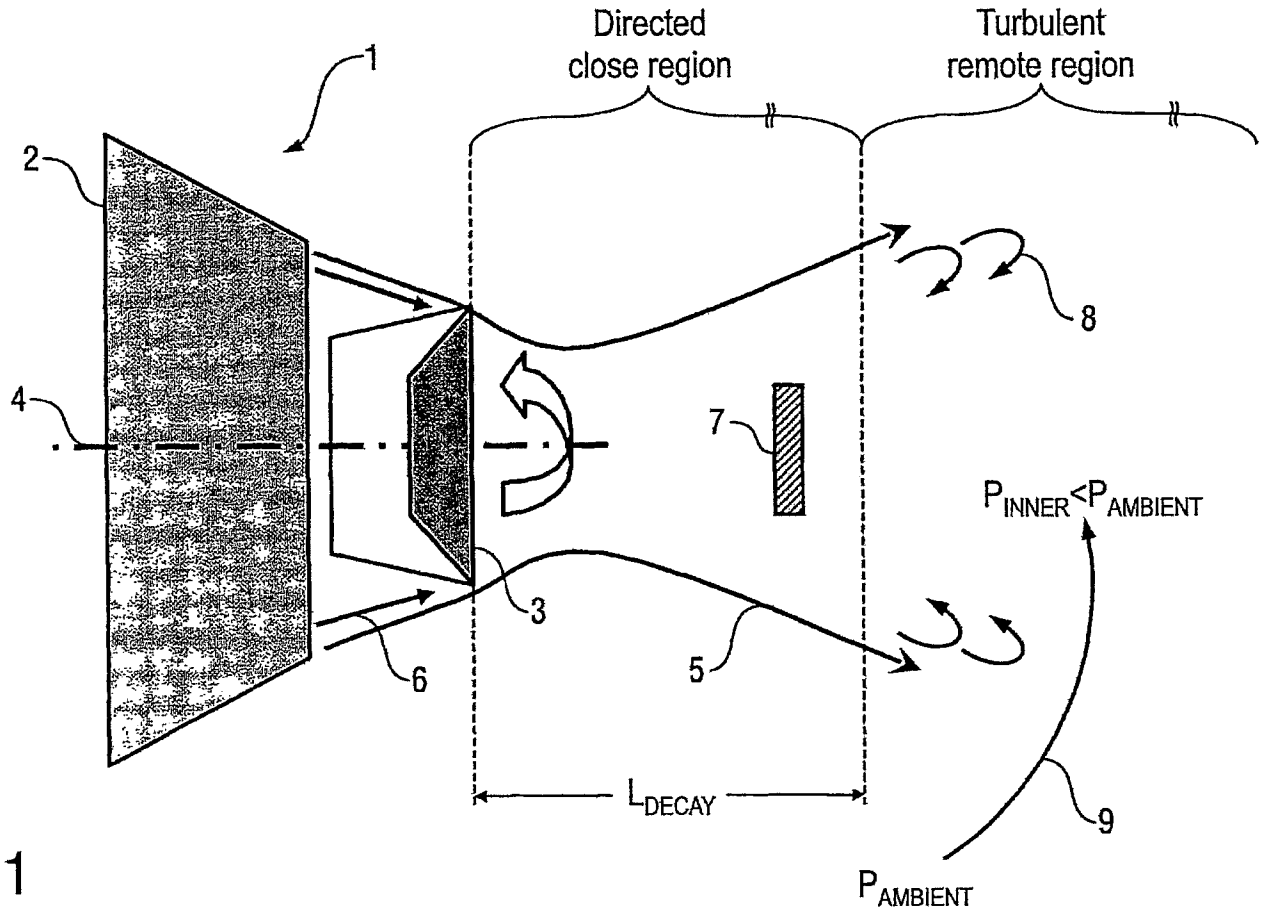
FIG. 1 a diagramed side-view of a rotary atomizer according to the exemplary illustrations herein, in which the subdivision of the spray jet into a low turbulence directed close region and a turbulent remote region is evident, FIGS. 2 to 6 different examples of shaping air rings according to the exemplary illustrations, with a variation of the jet direction or the nozzle cross-section of the individual shaping air nozzles along the circumference of the shaping air ring, FIG. 7 a highly diagramed side-view of a rotary atomizer with a shaping air ring that discharges a shaping air jet that is inclined radially inward and intersects, FIG. 8 a highly simplified side-view of a rotary atomizer with a shaping air ring that discharges three shaping air jets inclined in different directions, FIG. 9 a simplified cross-sectional view of a shaping air nozzle with a stepped inner contour for generating turbulences, FIG. 10 a simplified cross-sectional view of a shaping air nozzle with an inner contour that widens conically in the direction of flow, FIG. 11 a simplified cross-sectional view of a shaping air nozzle according to the exemplary illustrations with an inner contour that is tapered in multiple steps in jet direction, FIG. 12 a simplified cross-sectional view of a shaping air nozzle according to the exemplary illustrations with an inner contour that is conically tapered in the jet direction, FIG. 13 a detail of a shaping air ring according to the exemplary illustrations with two shaping air nozzles that are traversed by a ring-shaped slit, FIG. 14 a simplified representation of a shaping air nozzle according to the exemplary illustrations with cross-shaped slits, FIG. 15 a simplified representation of a shaping air nozzle with an inclined nozzle mouth for distorting the flow profile of the emerging shaping air jet, FIG. 16 a simplified representation of a shaping air nozzle formed by a notch into which a shaping air bore opens, as well as FIG. 17 a simplified cross-sectional view of a shaping air nozzle formed by a notch into which two shaping air bores open.

The exemplary illustrations provided herein are generally based on techno-physical realization that frictional effects within the interior of a spray jet generate a negative pressure which contributes to a concentration of the spray jet so that the spray jet is stable over relatively great distances. In addition, the friction on the outer lateral surface of the spray jet is generally too small to create any substantial widening of the spray jet. As a result, the spray jet discharged by the rotary atomizer can have a great spatial length while keeping up the inner flow velocity, so that particles of the coating agent applied can still cause soiling at a great distance from the rotary atomizer.

The present disclosure therefore includes the general technical teaching of generating turbulences within the shaping air jet in a targeted manner and thus in the spray jet as well, in order to limit the undisturbed range of the spray jet, and thus the spatial soiling potential, to a predetermined distance. It should be taken in to consideration here that turbulences in the spray jet are on principle undesirable, and, within the context of the exemplary illustrations, should therefore be restricted to a remote region. In a close region, e.g., within the predetermined distance described above, the spray jet and the surrounding shaping air jet respectively should, however, preferably be of low turbulence and directed so that the coating quality is not affected by turbulences. An exemplary spray jet therefore has a substantially greater degree of turbulence in the remote region than it does in the close region.

To generate the turbulences in the shaping air jet, the exemplary illustrations provide for additional irregularities in comparison to a conventional shaping air ring with a rotationally symmetrical arrangement of shaping air nozzles, which irregularities retain the original shaping function of the spray jet on the one hand, but, through a targeted variation of flow velocity and/or direction of flow, also disturb the laminarity or homogeneity in the shaping air jet to the extent that turbulences are generated in the remote region, which destroy flow energy, reduce flow velocity and widen the shaping air jet and thus also the spray jet. In addition, effects thus actively induced or generated in the lateral surface of the flow cylinder enable inflow of ambient air into the inner negative-pressure region of the spray jet, thereby reducing the above-mentioned concentrating forces subsequently.

In one example, the shaping air jet has a length of decay from the shaping air ring to the turbulent remote region that is shorter than 1 m, 75 cm, 50 cm, 40 cm, 30 cm or 20 cm. The spatial soiling potential of the atomizer is thereby limited to the close region of the atomizer, i.e., within the predetermined distance of 1 m, 75 cm, 50 cm, 40 cm, 30 cm or 20 cm, so that soiling of distant surfaces beyond the predetermined distance is prevented.

In addition, the length of decay of the shaping air jet is preferably greater than the component distance between the shaping air ring and the component to be coated, so that the component to be coated is located within the directed and low turbulence close region of the spray jet. This is advantageous as the component to be coated is then located within the close region so that the quality of coating is not affected by the relatively strong turbulences in the remote region.

In an exemplary shaping air ring, the irregularities for generating the turbulences include shaping air nozzles that are arranged asymmetrically with respect to the spray axis or the axis of rotation of the atomizer, i.e. are not rotationally symmetrical.

For example, the nozzle cross-section and/or the jet direction of the individual shaping air jets can be varied along the circumference of the shaping air ring for generating the turbulences. In varying the flow velocity along the circumference of the shaping air ring, faster and slower flows are then flowing next to one another within the shaping air jet, which leads to velocity gradients, and thus flow friction within the spray jet, whereby turbulences are then generated in the course of the spray jet.

In one exemplary illustration with shaping air nozzles in a ring-shaped arrangement, a part of the shaping air nozzles have a jet direction that is substantially aligned parallel to the spray axis of the atomizer, while another part of the shaping air nozzles have a jet direction that, compared to the spray axis, are inclined radially inward. For instance, the shaping air ring can have six groups of five shaping air nozzles each, three groups having shaping air nozzles that are substantially aligned parallel to the spray axis, while the other three groups comprise shaping air nozzles that have a spray direction which, compared to the spray axis, is inclined radially inward.

In another example of a shaping air ring with a ring-shaped arrangement of the shaping air nozzles, a part of the shaping air nozzles have a jet direction that is inclined radially inward compared to the spray axis of the atomizer, while another part of the shaping air nozzles has a jet direction that, compared to the spray axis, is inclined radially outward. Thus, the individual shaping air nozzles are inclined either radially inward or radially outward. Preferably, the individual shaping air nozzles are also subdivided into groups with a uniform jet direction here, wherein the different groups of shaping air nozzles are arranged alternately in a circumferential direction.

Another exemplary shaping air ring with a ring-shaped arrangement of the shaping air nozzles may include a portion of the shaping air nozzles arranged along an inner ring, while another portion of the shaping air nozzles is arranged on an outer ring. Here, the shaping air nozzles on the inner ring may have a jet direction that is inclined radially outward compared to the spray axis, while the shaping air nozzles on the outer ring preferably have a jet direction that is inclined radially inward compared to the spray axis. Here also, the shaping air nozzles may be arranged in groups with a uniform jet direction, the different groups being arranged alternately in a circumferential direction.

By contrast, in another exemplary illustration, the shaping air jet has the form of a planar jet. For this purpose, two groups of shaping air nozzles placed opposite one another each have a jet direction that is inclined radially inward compared to the spray axis, while two other groups of shaping air nozzles, also placed opposite one another, have a jet direction that is aligned substantially parallel to the spray axis or is inclined radially outward compared to the spray axis. Thus, the shaping air nozzles inclining radially inward compress the resulting shaping air jet together into a planar jet.

In a further exemplary illustration of a shaping air ring with a ring-shaped arrangement of the shaping air nozzles, the individual shaping air nozzles have a jet direction that is inclined radially inward compared to the spray axis, which leads to a crossing shaping air flow and causes a constriction of the spray jet downstream behind the bell cup. Behind the constriction, however, the shaping air jet or the spray jet have in this example a widening with the soil-producing range of the spray jet being reduced.

In the examples described above, the irregularities for generating the turbulences substantially consist of variations in the jet direction of the shaping air nozzles. The irregularities for generating the desired turbulences can, however, also consist of variations in the nozzle cross-sections of the individual shaping air nozzles, which lead to corresponding variations in flow velocity. In a ring-shaped arrangement of the shaping air nozzles, for example, the nozzle cross-section can be varied along the circumference of the shaping air ring and the shaping air nozzles can again be divided into different groups with uniform cross-sections.

In addition, the irregularities for generating the turbulences can consist in that the nozzle cross-section of the shaping air nozzles is conically widened or tapered in the direction of flow.

Furthermore, it is possible to alter the nozzle cross-section in the direction of flow with one or more steps, with a tapering or widening of the nozzle cross-section being possible again.

Beyond that, within the context of the present disclosure, there is the possibility that the irregularities for generating turbulences consist of slits that are adjacent to the shaping air nozzles and substantially run parallel to the direction of flow. In a ring-shaped arrangement of the individual shaping air nozzles, the slit can likewise be arranged in a ring shape along the shaping air nozzle ring and intersecting all of the shaping air nozzles. Alternatively, there is also the possibility to arrange the slits in a cross shape and concentrically with the individual shaping air nozzles.

Furthermore, the irregularities for generating turbulences can consist in the flow profile of the shaping air nozzles being distorted in a targeted manner. Within the context of the exemplary illustrations, the nozzle mouth of an individual shaping air nozzle can be inclined in opposition to the preceding shaping air bore.

In addition, the irregularities for generating turbulences can also be formed by notches into each of which one or more (for example, 2 or 3) shaping air bores open, wherein the notches are preferably triangular in cross-section and form the shaping air nozzles.

It should furthermore be mentioned that the exemplary illustrations encompass not only the shaping air ring according as described above, but also an atomizer with such a shaping air ring as well as a coating machine, in particular a painting robot with such a rotary atomizer.

Finally, the present disclosure and exemplary illustrations also encompass a corresponding coating process, which arises from the above description.

The side-view in FIG. 1 shows in highly simplified form a rotary atomizer 1 with a shaping air ring 2 and a bell cup 3 which in operation rotates on a rotational axis 4 and discharges a spray jet 5 in a conventional manner.

The shaping air ring 2 has on its front side numerous shaping air nozzles, which are arranged in a ring shape and direct a shaping air jet 6 from behind onto the lateral surface of the bell cup 3 so that the spray jet 5 has a constriction behind the bell cup 3 and subsequently widens in jet direction.

Using the arrangement of the shaping air nozzles according to the exemplary illustrations in the FIGS. 2 to 6, the spray jet 5 is subdivided into a low turbulence directed close region and a turbulent remote region, the spray jet 5 falling apart after a predetermined distance, e.g., decay length $L_{DECAY}$, at the transition from the close region to the remote region.

Here, the rotary atomizer 1 is guided such that the component to be coated 7 is located within the directed close region, such that the coating of the component 7 is not disturbed by turbulences.

In the turbulent remote region, however, turbulences 8 are generated that destroy the flow energy of the spray jet 5 and reduce its velocity, thus contributing to a widening of the spray jet 5. In addition, defects are generated in the lateral surface of the spray jet 5, which enable the inflow 9 of ambient air into the inner negative-pressure region of the spray jet 5, so that the concentrating forces of the spray jet 5 are reduced.

Here, the turbulences 8 are generated in a targeted manner with the shaping air nozzles in the shaping air ring 2 having irregularities compared to a rotationally symmetric arrangement, for instance variations in jet direction and/or nozzle cross-section.

Figure 2:
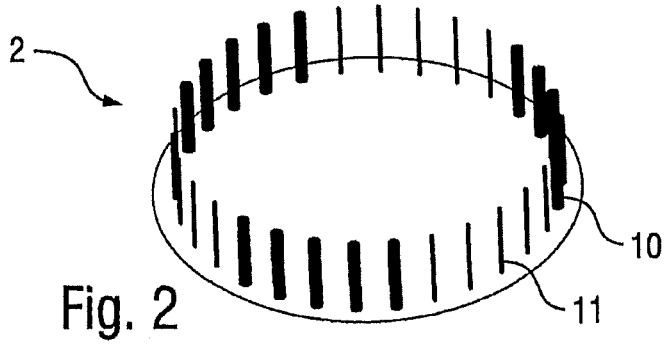

FIG. 2 shows a simplified perspective view of a modification of the shaping air ring 2 from FIG. 1, this modification being largely in accordance with the example shown in FIG. 1, such that, for avoiding repetitions, reference is made to the above description and the same reference numerals are subsequently used for corresponding details.

One distinctive feature of this exemplary illustration consists in that different shaping air nozzles 10, 11 are distributed along the circumference of the shaping air ring 2, wherein the shaping air nozzles 11 have a smaller nozzle cross-section than the shaping air nozzles 10, which leads to correspondingly different flow velocities.

Here, the shaping air nozzles 10 or 11, respectively, are subdivided into six groups of five shaping air nozzles 10 and 11, respectively, each, wherein the shaping air nozzles 10 and 11, respectively, within the individual groups each have a uniform nozzle cross-section.

Along the circumference of the shaping air ring 2, therefore, slower and faster shaping air flows emerge next to one another, so that the flow friction resulting from this velocity difference generates turbulences in the further course of the shaping air jet.

Figure 3:
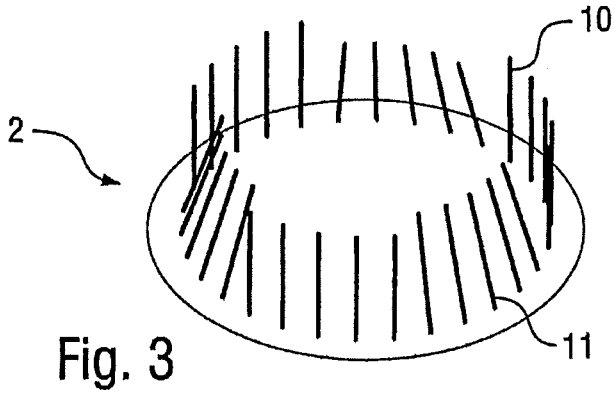

The exemplary illustration according to FIG. 3 largely corresponds to that mentioned above and illustrated in FIG. 2, so that, for avoiding repetitions, reference is made to the above description and the same reference numerals are subsequently used for corresponding details.

One distinctive feature of this example consists in that the shaping air nozzles 10, 11 do not differ by the nozzle cross-section, but rather by the jet direction. The shaping air nozzles 10 thus have a jet direction that is substantially aligned parallel to the rotational axis 4 of the bell cup 3. The shaping air nozzles 11, however, have a jet direction that is inclined radially inward compared to the rotational axis 4, the angle of inclination being preferably in a region between 5° and 30°.

Figure 4:
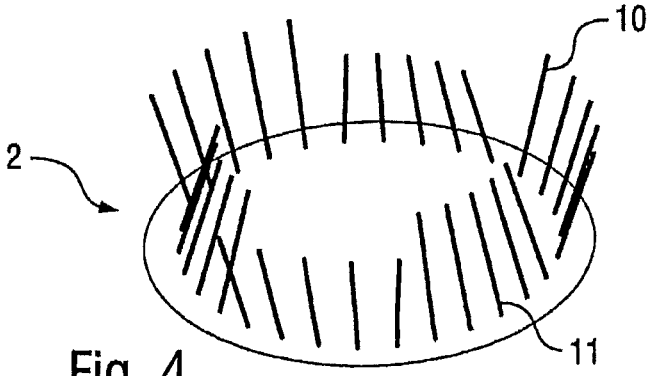

FIG. 4 shows a further exemplary illustration of the shaping air ring 2 that largely corresponds to the example described above and illustrated in FIG. 2, such that, for avoiding repetitions, reference is made to the above description and the same reference numerals are subsequently used for corresponding details.

One distinctive feature of this example consists in that the shaping air nozzles 10 have a jet direction that is directed radially outward compared to the rotational axis 4 of the bell cup 3, whereas the shaping air nozzles 11 have a jet direction that is directed radially inward compared to the rotational axis 4 of the bell cup 3.

Figure 5:
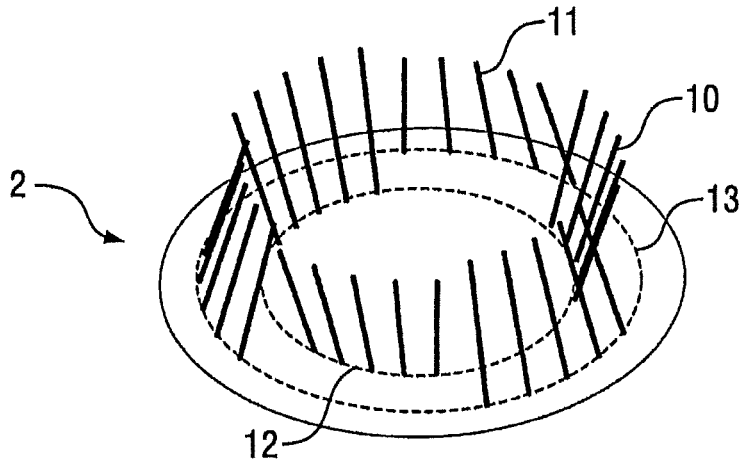

FIG. 5 shows a further exemplary illustration of the shaping air ring 2, this example largely corresponding to that described above and illustrated in FIG. 2, so that, for avoiding repetitions, reference is made to the above description and the same reference numerals are used for corresponding details.

One distinctive feature of this example consists in that the shaping air nozzles 10 are arranged on an inner ring 12, while the shaping air nozzles 11 are arranged on an outer ring 13, both rings 12, 13 being concentrically arranged.

The shaping air nozzles 11 on the outer ring 13 here have a jet direction that is radially inclined inward compared to the rotational axis 4 of the bell cup 3.

In this example, the shaping air nozzles 10 on the inner ring 12 have, however, a jet direction that is directed radially outward compared to the rotational axis 4 of the bell cup 3.

Figure 6:
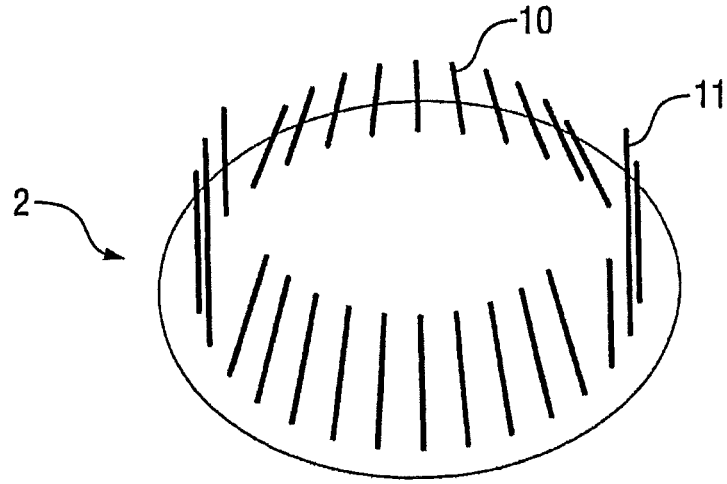

FIG. 6 shows a further exemplary illustration of the shaping air ring 2, wherein this example also largely corresponds to that described above and illustrated in FIG. 2, so that, for avoiding repetitions, reference is made to the above description and the same reference numerals are used for corresponding details.

One distinctive feature of this example consists in that the shaping air nozzles 10 have a jet direction that is inclined radially inward compared to the rotational axis 4 of the bell cup 3, whereas the other shaping air nozzles 11 have a jet direction that is substantially parallel to the axis of the jet direction. Thus, the shaping air nozzles 10 constrict the shaping air jet, such that the shaping air flow assumes the form of a planar jet.

Figure 7:
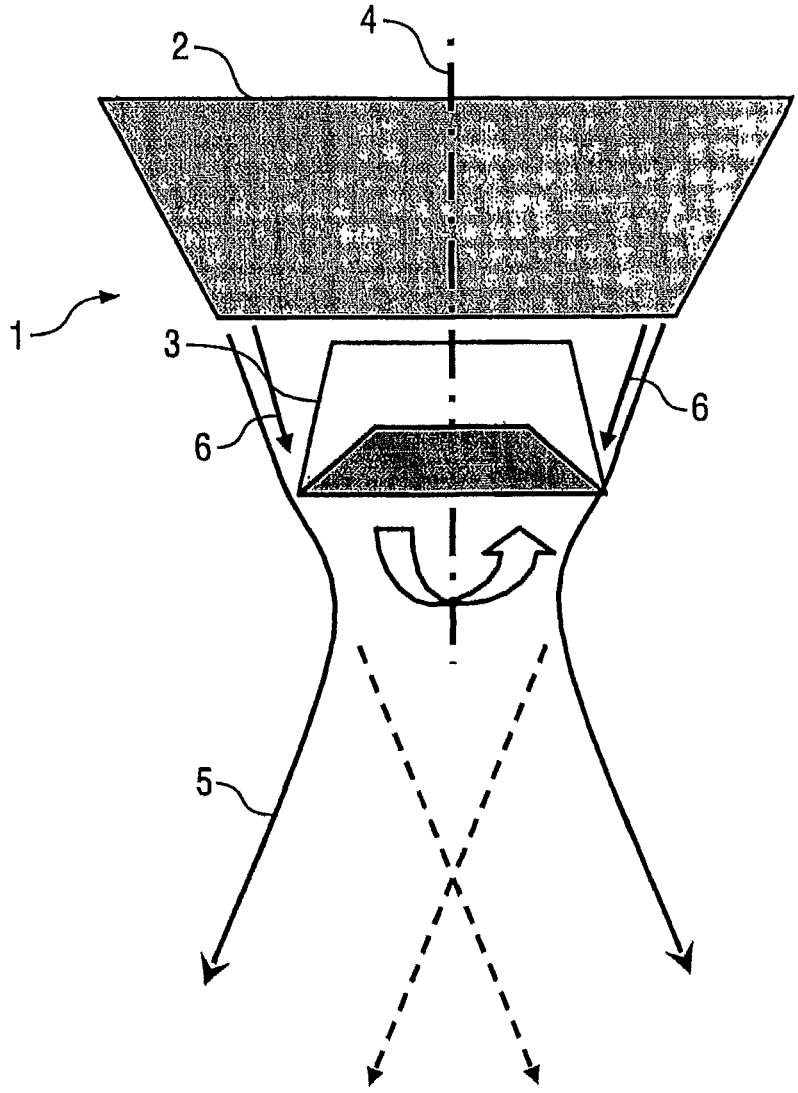

FIG. 7 largely corresponds to the representation in FIG. 1, so that, for avoiding repetitions, reference is made to the above description of FIG. 1. An additional outcome of this representation is that, due to the jet direction being inclined inward, the shaping air ring 2 discharges an intersecting shaping air jet 6.

Figure 8:
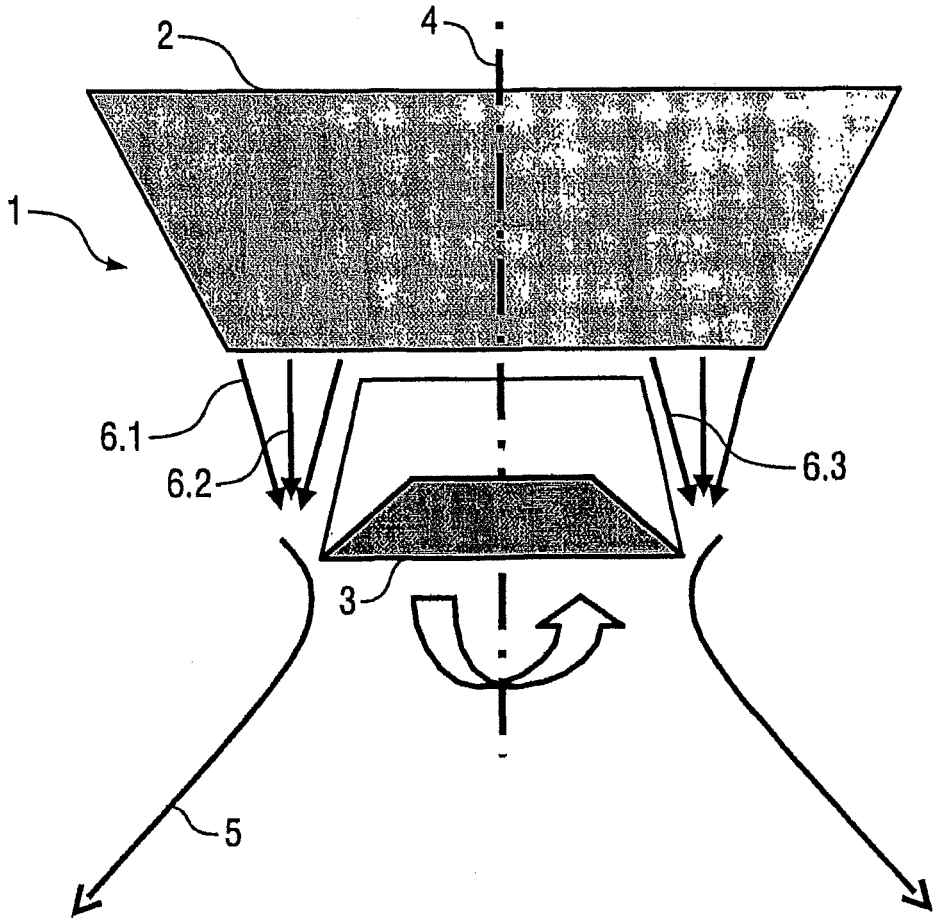

FIG. 8 also shows an exemplary shaping air ring 1, wherein this example largely corresponds to the example described above and illustrated in FIG. 1, so that, for avoiding repetitions, reference is made to the above description and the same reference numerals are used for corresponding details.

One distinctive feature of this example consists in that the shaping air ring 2 has three concentric shaping air nozzle rings that discharge shaping air jets 6.1, 6.2 and 6.3.

The outer shaping air jet 6.1 here has a jet direction that is inclined radially inward compared to the rotational axis 4. The middle shaping air jet 6.2, however, has a jet substantially parallel with the jet direction. Finally, the inner shaping air jet 6.3 has a jet direction that is inclined radially outward compared to the rotational axis 4 of the bell cup 3.

Figure 9:
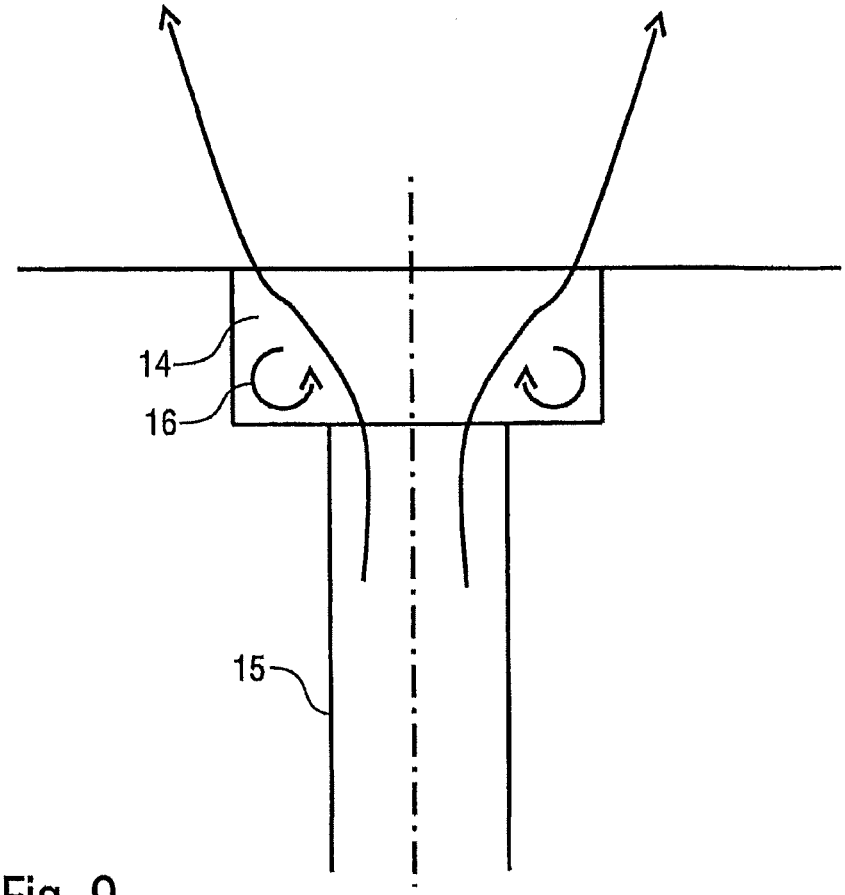

FIG. 9 shows a simplified cross-sectional view of a shaping air nozzle 14 according to an exemplary illustration that is fed with shaping air from a shaping air bore 15. In so doing, the shaping air nozzle 14 widens step-wise here at the transition from the shaping air bore 15 to the shaping air nozzle 14, turbulences being generated in the shaping air nozzle 14.

Figure 10:
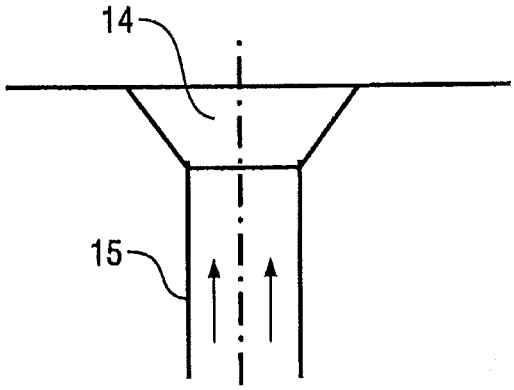

FIG. 10 shows a simplified cross-sectional view of a further example of a shaping air nozzle 14, which in part corresponds to FIG. 9, so that, for avoiding repetitions, reference is made to the above description and the same reference numerals are used for corresponding details.

One distinctive feature of this example consists in that the shaping air nozzle at the transition of the shaping air bore 15 not widens step-wise, but rather conically.

Figure 11:
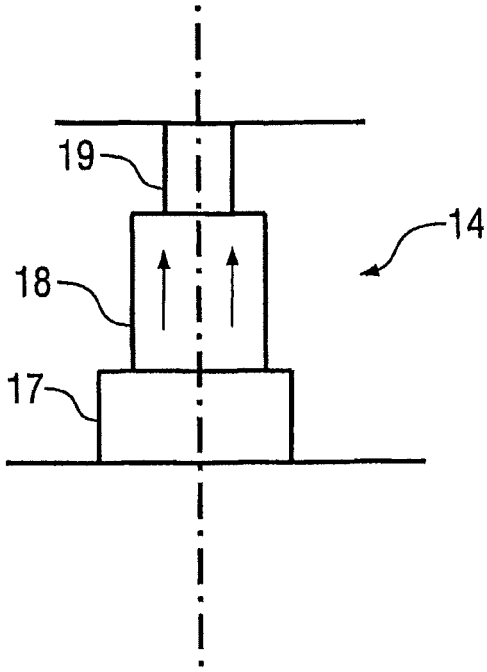

FIG. 11 shows a further exemplary illustration of a shaping air nozzle 14, which in part corresponds to FIG. 9, so that, for avoiding repetitions, reference is made to the above description and the same reference numerals are used for corresponding details.

One principal distinctive feature of this example consists in that the shaping air nozzle 14 does not widen in the jet direction, but rather is tapered in the jet direction.

On the other hand, the shaping air nozzle 14 has three consecutive stepped nozzle sections 17, 18 and 19, the cross-sections of which diminish in the direction of flow.

Figure 12:
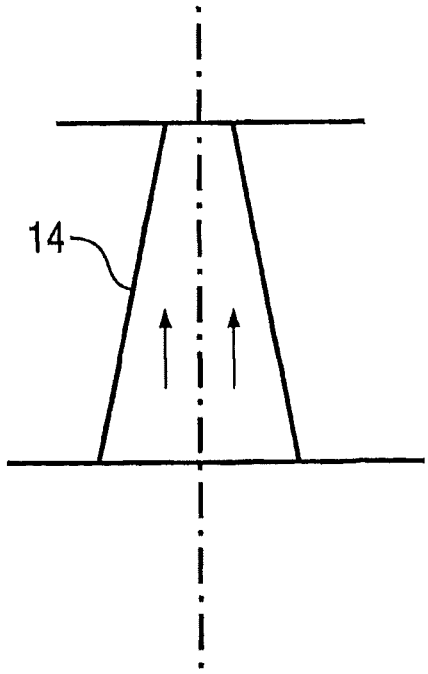

In addition, the example shown in FIG. 12 partly corresponds to the above-described examples, so that, for avoiding repetitions, reference is made to the above description and the same reference numerals are used for corresponding details.

One distinctive feature consists in that the shaping air nozzle 14 is tapered in the direction of flow.

A further distinctive feature of this example consists in that the shaping air nozzle 14 has a conical inner contour.

Figure 13:
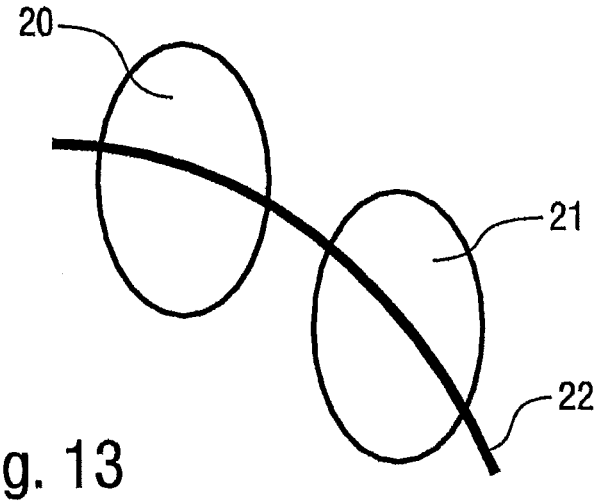

FIG. 13 shows a detail from a shaping air ring according to the exemplary illustrations with shaping air nozzles arranged in a ring shape, wherein only two shaping air nozzles 20, 21 are illustrated in the drawing. In this case, a ring-shaped slit 22, the diameter of which matches the diameter of the shaping air ring, runs through both shaping air nozzles 20, 21.

Figure 14:
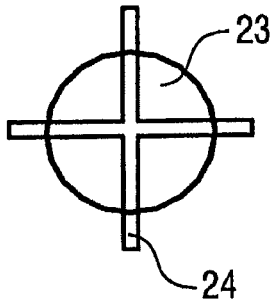

FIG. 14 shows a schematic representation of a shaping air nozzle 23 according to an exemplary illustration with a cross-shaped, concentric slit arrangement 24.

Figure 15:
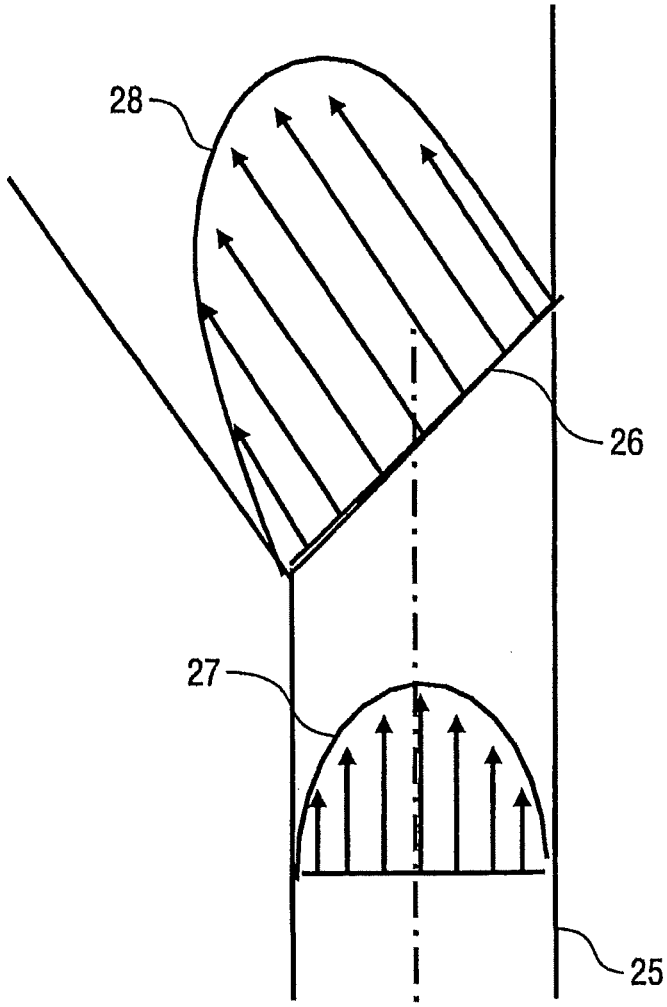

The example according to FIG. 15 provides for a distortion of the flow profile in order to generate turbulences. Here, a shaping air bore 25 opens into a shaping air nozzle 26, the nozzle cross-section of the shaping air nozzle 26 being inclined compared to the cross-section of the shaping air bore 25. The shaping air flow in the shaping air bore 25 therefore has a conventional parabolic profile 27, while the shaping air jet emerging from the shaping air nozzle 26 has a distorted flow profile 28.

Figure 16:
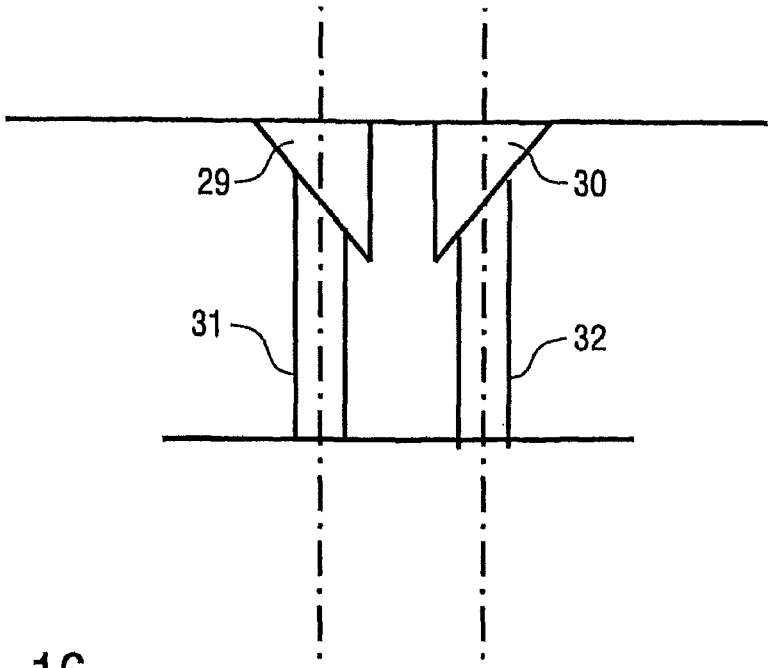

FIG. 16 furthermore shows two shaping air nozzles that are formed by notches 29, 30, with a shaping air bore 31, 32 opening into both notches 29, 30. Here, both notches 29, 30 each are triangular in cross-section.

Figure 17:
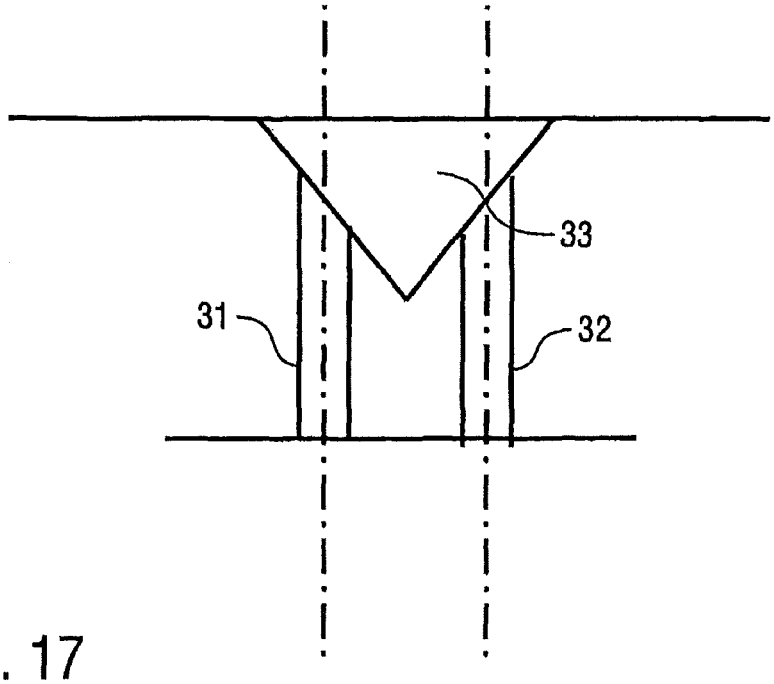

The example shown in FIG. 17 again largely corresponds to that shown in FIG. 16, so that, for avoiding repetitions, reference is made to the above description and the same reference numerals are used for corresponding details.

One distinctive feature of this exemplary illustration consists in that both shaping air bores 31, 32 open into a common notch 33 that forms a shaping air nozzle and is likewise triangular in cross-section.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

LIST OF REFERENCE NUMERALS

1 Rotary atomizer
2 Shaping air ring
3 Bell cup
4 Rotational axis
5 Spray jet
6 Shaping air jet
7 Component
8 Turbulences
9 Inflow
10, 11 Shaping air nozzles
12 Inner ring
13 Outer ring
14 Shaping air nozzle
15 Shaping air bore
16 Turbulences
17-19 Nozzle section
20, 21 Shaping air nozzles
22 Slit
23 Shaping air nozzle
24 Slit arrangement
25 Shaping air bore
26 Shaping air nozzle
27, 28 Flow profile
29, 30 Notches
31, 32 Shaping air bore
33 Notch

The invention claimed is:

1. A shaping air ring comprising:

a plurality of shaping air nozzles for discharging a shaping air jet for shaping a spray jet of an atomizer, the shaping air nozzles being formed such that the shaping air jet and the spray jet contain directed flows within a first region proximate to the shaping air ring;

wherein the shaping air nozzles are formed such that the shaping air jet generates, in a targeted manner, more turbulences in a second region of the spray jet downstream of the first region so that the shaping air jet and the spray jet contain substantially more turbulences in the remote region than in the close region; and wherein at least one slit is provided on each of the shaping air nozzles, the shaping air nozzles are arranged in a ring shape, and the slit runs through the shaping air nozzles in a ring-shaped manner, wherein a first set of the shaping air nozzles is arranged at a first inclination with respect to a spray axis of the atomizer and a second set of the shaping air nozzles is arranged at a second inclination with respect to the spray axis of the atomizer.

2. The shaping air ring according to claim 1, wherein a) there is a predetermined length of decay of the spray jet between the shaping air ring and the turbulent remote region of the shaping air jet, b) there is a predetermined component distance between the shaping air ring and the component to be coated, c) the length of decay of the shaping air jet is shorter than a value which is selected from a group consisting of: 1 m, 75 cm, 50 cm, 40 cm, 30 cm, 20 cm and 15 cm, and d) the length of decay of the shaping air jet is longer than the component distance so that a component to be coated is located within the directed close region.

3. The shaping air ring according to claim 1, wherein a) the spray jet and the shaping air jet are substantially rotationally symmetrical, b) the spray jet has an inner negative-pressure region, and c) the turbulences in the remote region cause an inflow of ambient air from the outside into the negative-pressure region of the spray jet.

4. The shaping air ring according to claim 1, wherein the shaping air nozzles are arranged in a ring shape and have different nozzle cross-sections, which vary along the circumference of the shaping air ring.

5. The shaping air ring according to claim 1, wherein a) the shaping air nozzles are arranged in a ring shape, and all have an inward-inclined jet direction, b) the shaping air jet has a constriction downstream of a bell cup, and c) the shaping air jet has a widening downstream of the constriction.

6. The shaping air ring according to claim 1, wherein the individual shaping air nozzles each have a nozzle cross-section that widens in the direction of flow.

7. The shaping air ring according to claim 6, wherein the nozzle cross-section conically changes in the direction of flow.

8. The shaping air ring according to claim 1, wherein the shaping air nozzles each are fed by a shaping air bore and have a nozzle cross-section that, compared to a cross-section of the shaping air bore, is inclined in order to distort the flow profile.

9. The shaping air ring according to claim 1, wherein the shaping air nozzles are formed by notches, into each of which one or two shaping air bores open.

10. The shaping air ring according to claim 9, wherein the notches are triangular in cross-section.

11. The shaping air ring according to claim 1, wherein the shaping air nozzles are arranged in a ring shape and have different jet directions, which vary along the circumference of the shaping air ring.

12. The shaping air ring according to claim 11, wherein a) the first set of the shaping air nozzles has a jet direction that is aligned substantially parallel to the spray axis of the atomizer, and b) the second set of the shaping air nozzles has a jet direction that is inclined radially inward compared to the spray axis.

13. The shaping air ring according to claim 11, wherein a) the first set of the other shaping air nozzles has a jet direction that is inclined radially inward compared to the spray axis, and b) the second set of the shaping air nozzles has a jet direction that is inclined radially outward compared to the spray axis.

14. The shaping air ring according to claim 11, wherein a) a portion of the shaping air nozzles is arranged on an inner ring, and b) another portion of the shaping air nozzles is arranged on an outer ring.

15. The shaping air ring according to claim 14, wherein a) the shaping air nozzles on the inner ring have a jet direction that is inclined radially outward compared to the spray axis, and b) the shaping air nozzles on the outer ring have a jet direction that is inclined radially inward compared to the spray axis.

16. The shaping air ring according to claim 11, wherein a) a plurality of different groups of the shaping air nozzles is arranged in a circumferential direction, b) the shaping air nozzles within the individual groups each have a uniform jet direction, and c) the neighboring groups differ by the jet direction of the respective shaping air nozzle.

17. The shaping air ring according to claim 11, wherein a) two groups of air nozzles being opposite to one another each have a jet direction that is inclined radially inward compared to the spray axis b) two other groups of air nozzles being opposite to one another have a jet direction that is aligned substantially parallel to the spray axis or is inclined radially outward compared to the spray axis, and c) the different groups are alternately arranged in a circumferential direction so that the shaping air jet is a planar jet.

18. The shaping air ring according to claim 11, wherein a) the shaping air nozzles are arranged on three concentric rings, b) the shaping air nozzles on the inner ring have a jet direction that is inclined radially outward compared to the spray axis of a bell cup, c) the shaping air nozzles on the middle ring have a jet direction that is aligned substantially parallel to the spray axis, and d) the shaping air nozzles on the outer ring have a jet direction that is inclined radially inward compared to the spray axis of the bell cup.

19. The shaping air ring according to claim 1, wherein the nozzle cross-section changes in the direction of flow in one of a single step and a plurality of steps.

20. The shaping air ring according to claim 19, wherein the nozzle cross-section widens in the direction of flow.

21. An atomizer that is a rotary atomizer with a shaping air ring according to claim 1.

22. A painting machine, comprising an atomizer according to claim 21.

23. A painting robot comprising an atomizer according to claim 21.

24. A coating process, comprising:

a) discharging a spray jet of a coating agent onto a component to be coated using an atomizer, the spray jet having a directed flow within a first region proximate to atomizer, b) discharging of a shaping air jet for shaping the spray jet by means of a shaping air ring with a plurality of shaping air nozzles, wherein a first set of the shaping air nozzles is arranged at a first inclination with respect to a spray axis of the atomizer and a second set of the shaping air nozzles is arranged at a second inclination with respect to the spray axis of the atomizer, and c) generating turbulences in a second region that is downstream of the first region of the spray jet in a targeted manner by the shaping air nozzles so that the shaping air jet and the spray jet contain substantially more turbulences in the second region than in the first region wherein:

there is a predetermined length of decay between the shaping air ring and the turbulent remote region of the spray jet, there is a predetermined component distance between the shaping air ring and the component to be coated, the length of decay of the spray jet is shorter than a value selected from a group consisting of: 1 m, 75 cm, 50 cm, 40 cm, 30 cm, 20 cm and 15 cm, and the decay length of the spray jet is longer than the component distance so that the component to be coated is located within the directed first region.

25. The coating process according claim 24, wherein a) the shaping air jet is substantially rotationally symmetrical, b) the shaping air jet has an inner negative-pressure region, and c) the turbulences in the remote region cause an inflow of ambient air from the outside into the negative-pressure region.

* * * * *